US009283579B2

(12) United States Patent
McGuffey

(10) Patent No.: US 9,283,579 B2
(45) Date of Patent: Mar. 15, 2016

(54) VARIABLE VOLUME HOT MELT ADHESIVE DISPENSING NOZZLE OR DIE ASSEMBLY WITH CHOKE SUPPRESSION

(71) Applicant: Grant McGuffey, Springfield, TN (US)

(72) Inventor: Grant McGuffey, Springfield, TN (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 13/795,865

(22) Filed: Mar. 12, 2013

(65) Prior Publication Data

US 2014/0263750 A1 Sep. 18, 2014

(51) Int. Cl.
*B05C 5/02* (2006.01)
*B05B 7/16* (2006.01)

(52) U.S. Cl.
CPC ..... *B05B 7/16* (2013.01); *B05C 5/0254* (2013.01); *B05C 5/0258* (2013.01); *B05C 5/0275* (2013.01); *B05C 5/0279* (2013.01)

(58) Field of Classification Search
CPC ... F23D 2203/108; B29C 47/06; B05C 5/027; B05C 5/0275; B05C 5/0279; B05C 5/0254; B05C 5/0258; B05C 5/02; D01D 4/025; D01D 5/0985; D04H 1/565; B05B 7/16
USPC ..... 239/555, 554, 553.5
See application file for complete search history.

(56) References Cited

U.S. PATENT DOCUMENTS

| | | | | |
|---|---|---|---|---|
| 5,862,986 | A | 1/1999 | Bolyard, Jr. et al. | |
| 5,882,573 | A | 3/1999 | Kwok et al. | |
| 5,902,540 | A | 5/1999 | Kwok | |
| 5,904,298 | A | 5/1999 | Kwok et al. | |
| 6,051,180 | A | 4/2000 | Kwok | |
| 6,375,099 | B1 * | 4/2002 | McGuffey | 239/553.5 |
| 6,680,021 | B1 * | 1/2004 | Kwok et al. | 264/555 |
| 6,719,846 | B2 * | 4/2004 | Nakamura et al. | 118/313 |
| 6,890,167 | B1 * | 5/2005 | Kwok et al. | 425/72.2 |
| 2004/0100861 | A1 * | 5/2004 | Vanden Bussche et al. | 366/165.1 |

* cited by examiner

*Primary Examiner* — Arthur O Hall
*Assistant Examiner* — Juan C Barrera
(74) *Attorney, Agent, or Firm* — Law Offices of Steven W. Weinrieb

(57) ABSTRACT

A dual, variable volume hot melt adhesive dispensing nozzle or die assembly is provided with a pair of choke slots within a first fluid control plate. The provision of the choke slots within the first fluid control plate effectively restricts and retards the flow of the fluid through such choke slots whereby volumes of the fluids are effectively built up and stored upstream of the choke slots so as to effectively delay the reaction of pressure spikes upon the fluid flows under both positive and negative conditions. This buildup in pressure and volume is then dispensed over time so as to cause the fluid flow to smoothly transition between positive and negative spiked fluid flow conditions and normal fluid flow conditions. Accordingly, the pressure spikes do not adversely affect the resulting fluid flows whereby, for example, under conventional negative pressure spike conditions, gaps in the dispensed hot melt adhesive would otherwise occur.

21 Claims, 4 Drawing Sheets

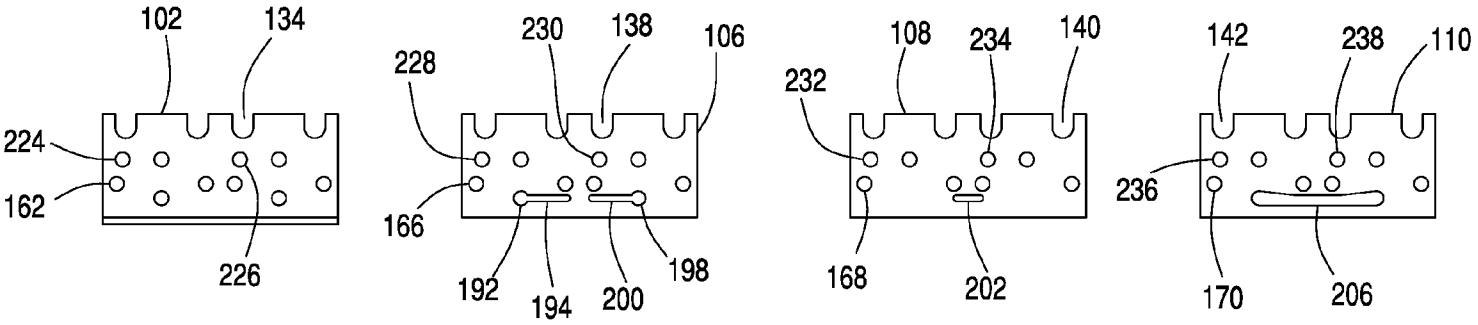
FIG. 3a
FIG. 3b
FIG. 3c
FIG. 3d
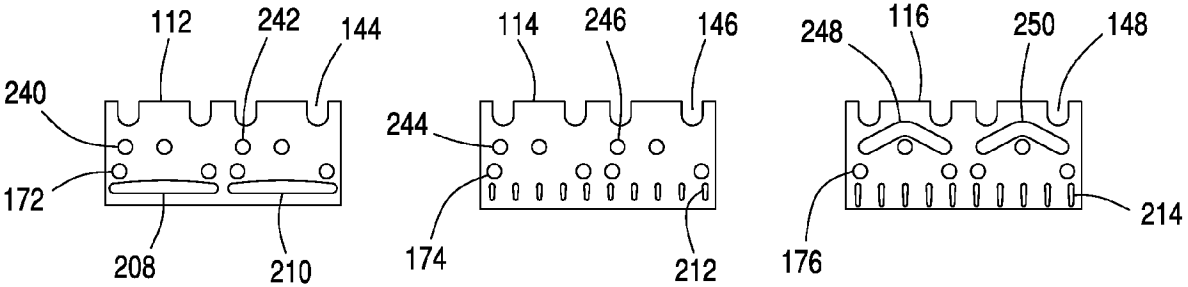
FIG. 3e
FIG. 3f
FIG. 3g

VARIABLE VOLUME HOT MELT ADHESIVE DISPENSING NOZZLE OR DIE ASSEMBLY WITH CHOKE SUPPRESSION

FIELD OF THE INVENTION

The present invention relates generally to hot melt adhesive dispensing systems, and more particularly to a new and improved hot melt adhesive dispensing system wherein in order to achieve desired and accurate variable output volumes of dispensed hot melt adhesives or other thermoplastic materials, from at least two different fluid flows, so as to satisfy predetermined distribution or application pattern parameters, the at least two different fluid flows are subjected to predetermined pressure modifications.

BACKGROUND OF THE INVENTION

Multi-plate and other types of hot melt adhesive or other thermoplastic material dispensing systems are well known in the fluid dispensing art and industry. Examples of United States Patents disclosing such hot melt adhesive or other thermoplastic material dispensing systems include U.S. Pat. No. 6,051,180 which issued to Kwok on Apr. 18, 2000, U.S. Pat. No. 5,904,298 which issued to Kwok et al. on May 18, 1999, U.S. Pat. No. 5,902,540 which issued to Kwok on May 11, 1999, U.S. Pat. No. 5,882,573 which issued to Kwok et al. on Mar. 16, 1999, and U.S. Pat. No. 5,862,986 which issued to Bolyard, Jr. et al. on Jan. 26, 1999. It is noted further that these patents are directed toward different types of hot melt adhesive dispensing systems, such as, for example, meltblowing, spray pattern dispensing, and the like.

As exemplified by means of U.S. Pat. No. 5,904,298 which issued to Kwok et al., the disclosed hot melt adhesive or other thermoplastic material dispensing system comprises a dual-component hot melt adhesive or other thermoplastic material dispensing system wherein two fluid flows are able to have their fluids dispensed from a plurality of output nozzles or orifices which are arranged within a transversely disposed array of output nozzles or orifices extending across the lateral extent of the nozzle or die assembly which is fluidically connected to a common manifold or head. In conjunction with such dual-component hot melt adhesive or other thermoplastic material dispensing systems, it is sometimes desired to dispense different volumes of one or both of the fluid flows depending upon the particular or predetermined hot melt adhesive or other thermoplastic material distribution or application pattern parameters to be achieved. In connection with such a dual-components variable volume hot melt adhesive or other thermoplastic material dispensing system, the two fluid flows to the transversely arrayed dispensing nozzles or orifices are respectively controlled by means of two volume control valves. Accordingly, it can be appreciated that with respect to volume deposition of the hot melt adhesive or other thermoplastic material onto an underlying substrate, six potential volume deposition states are possible. The first volume deposition state that can occur is where both of the volume control valves are closed whereby the volume of hot melt adhesive or other thermoplastic material that is dispensed onto the substrate is zero. The second volume deposition state that can occur is where the first volume control valve is open while the second volume control valve is closed whereby the volume of hot melt adhesive or other thermoplastic material that is dispensed onto the substrate is the volume of fluid controlled by means of the first volume control valve. The third volume deposition state that can occur is where the first volume control valve is closed while the second volume control valve is open whereby the volume of hot melt adhesive or other thermoplastic material that is dispensed onto the substrate is the volume of fluid controlled by means of the second volume control valve. The fourth volume deposition state that can occur is where the first volume control valve is maintained open while the second volume control valve is cyclically opened and closed whereby the volume of hot melt adhesive or other thermoplastic material that is dispensed onto the substrate comprises the volume of fluid controlled by means of the first volume control valve to which is added or superimposed in a cyclical or intermittent manner, onto the volume of hot melt adhesive or other thermoplastic material controlled by means of the first volume control valve, the volume of hot melt adhesive or other thermoplastic material controlled by means of the second volume control valve. The fifth volume deposition state that can occur is where the second volume control valve is maintained open while the first volume control valve is cyclically opened and closed whereby the volume of hot melt adhesive or other thermoplastic material that is dispensed onto the substrate comprises the volume of fluid controlled by means of the second volume control valve to which is added or superimposed in a cyclical or intermittent manner, onto the volume of hot melt adhesive or other thermoplastic material controlled by means of the second volume control valve, the volume of hot melt adhesive or other thermoplastic material controlled by means of the first volume control valve. Lastly, the sixth volume deposition state that can occur is where both of the volume control valves are open whereby the volume of hot melt adhesive or other thermoplastic material that is dispensed onto the substrate comprises the combined volumes of the hot melt adhesive or other thermoplastic material as controlled by both of the volume control valves.

While this conventional system admittedly functions satisfactorily, some operational difficulties and drawbacks have been experienced and noted. More specifically, during the aforenoted fourth and fifth operational states, hydraulic conditions can be such as to effectively be detrimental to the desired depositional results. For example, in connection with the fourth operative state, a first volume of hot melt adhesive is being continuously supplied from the first fluid flow path as a result of the first control valve being maintained open, however, a second volume of hot melt adhesive is effectively being superimposed onto the first volume of hot melt adhesive, from a second fluid flow path, as a result of the cyclical opening and closing of the second control valve. It has been experienced that when the second control valve is closed such that the flow of the second volume of hot melt adhesive is stopped or terminated, the inertial flow of the second volume of hot melt adhesive effectively undergoes, creates, or results in a negative pressure spike or drop which can negatively impact the volume flow of the first hot melt adhesive from the first fluid flow path. This negative impact upon the volume flow of the first hot melt adhesive from the first fluid flow path has in fact manifested itself as a momentary cessation in the dispensed volume of hot melt adhesive from the lateral or transverse array of dispensing dies or nozzle assemblies, whereby a gap in the hot melt adhesive, dispensed from the lateral or transverse array of dispensing dies or nozzle assemblies, appears upon the underlying substrate. A positive pressure spike will likewise occur when one of the fluid flows, having been previously taken off-line as a result of its control valve having been closed, again comes back on-line as a result of its control valve again being opened, whereby it is needed to effectively accommodate such positive pressure spikes in order to maintain the proper volumetric fluid flow of the hot melt adhesive.

A need therefore exists in the art for a new and improved variable volume hot melt adhesive or other thermoplastic material dispensing nozzle or die assembly wherein structure is incorporated therein such that the aforenoted negative or positive pressure spikes are, in effect, isolated, reduced, or effectively attenuated over a period of time whereby gaps in the dispensed volumes of hot melt adhesive do not occur when the system experiences a negative pressure spike, and in the instance of the system experiencing a positive pressure spike, the flow of the hot melt adhesive is nevertheless likewise controlled and stabilized such that the flow of the hot melt adhesive or other thermoplastic material can continue at the desired volumetric level until the normal line pressure has again been achieved over the requisite period of time.

SUMMARY OF THE INVENTION

The foregoing and other objectives are achieved in accordance with the teachings and principles of the present invention through the provision of a new and improved dual, variable volume hot melt adhesive dispensing nozzle or die assembly wherein a pair of choke slots are provided within a first fluid control plate. The provision of the choke slots within the first fluid control plate effectively restricts and retards the flow of the fluid through such choke slots whereby volumes of the fluids are effectively built up and stored upstream of the choke slots so as to effectively delay the reaction of pressure spikes upon the fluid flows under both positive and negative conditions. This buildup in pressure and volume is then dispersed or effectively attenuated over a period of time so as to cause the fluid flow to smoothly transition between positive and negative spiked fluid flow conditions and normal fluid flow conditions. Accordingly, the pressure spikes do not adversely affect the resulting fluid flows whereby, for example, under conventional negative pressure spike conditions, gaps in the dispensed hot melt adhesive would otherwise occur.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
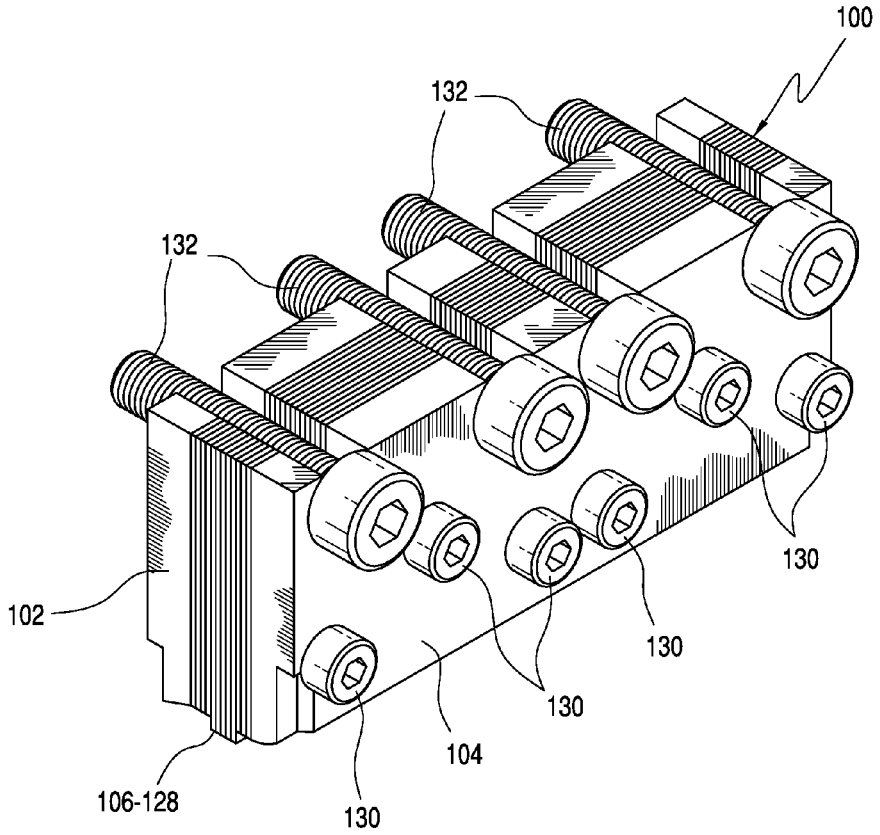
FIG. 1 is a perspective view of a new and improved variable volume hot melt adhesive dispensing nozzle or die assembly as constructed in accordance with the principles and teachings of the present invention.

Referring now to the drawings, and more particularly to FIG. 1 thereof, a new and improved variable volume hot melt adhesive dispensing nozzle or die assembly, constructed in accordance with the principles and teachings of the present invention, is disclosed and is generally indicated by the reference character 100. It is seen that the dispensing nozzle or die assembly 100 comprises a first interior assembly cover plate 102, a second exterior assembly cover plate 104, and a plurality of fluid control plates 106-128 interposed between the first interior assembly cover plate 102 and the second exterior assembly cover plate 104. The plurality of fluid control plates 106-128 are adapted to control or determine the flow of the hot melt adhesive or other thermoplastic material and heat air fluids to be conducted through the dispensing nozzle or die assembly 100, wherein the specific details of the plurality of fluid control plates 106-128 will be more fully appreciated from FIGS. 2 and 3*a*-3*n*, as well as from the detailed description of the same which follows hereinafter. As can best be seen from FIGS. 1-3*n*, a plurality of screw bolts 130 are adapted to pass through the first interior assembly cover plate 102, the second exterior assembly cover plate 104, and the plurality of fluid control plates 106-128 so as to fixedly secure all of the plates together, while a plurality of fasteners 132 are adapted to mount the assembled dispensing nozzle or die assembly 100 onto a suitable support surface, not shown. More particularly, it is seen that the upper edge portion of the first interior assembly cover plate 102 is provided with a plurality of apertures 134 for accommodating the plurality of fasteners 132, the upper edge portion of the second exterior assembly cover plate 104 is provided with a plurality of apertures 136 for accommodating the plurality of fasteners 132, and the upper edge portions of each one of the fluid control plates 106-128 are likewise provided with a plurality of apertures 138-160 for accommodating the plurality of fasteners 132. In a similar manner, it is seen that the central portion of the first interior assembly cover plate 102 is provided with a plurality of apertures 162 for accommodating the plurality of screw bolts 130, the central portion of the second exterior assembly cover plate 104 is provided with a plurality of apertures 164 for accommodating the plurality of screw bolts 130, and the central portions of each one of the fluid control plates 106-128 are likewise provided with a plurality of apertures 166-188 for accommodating the plurality of screw bolts 130.

Figure 2:
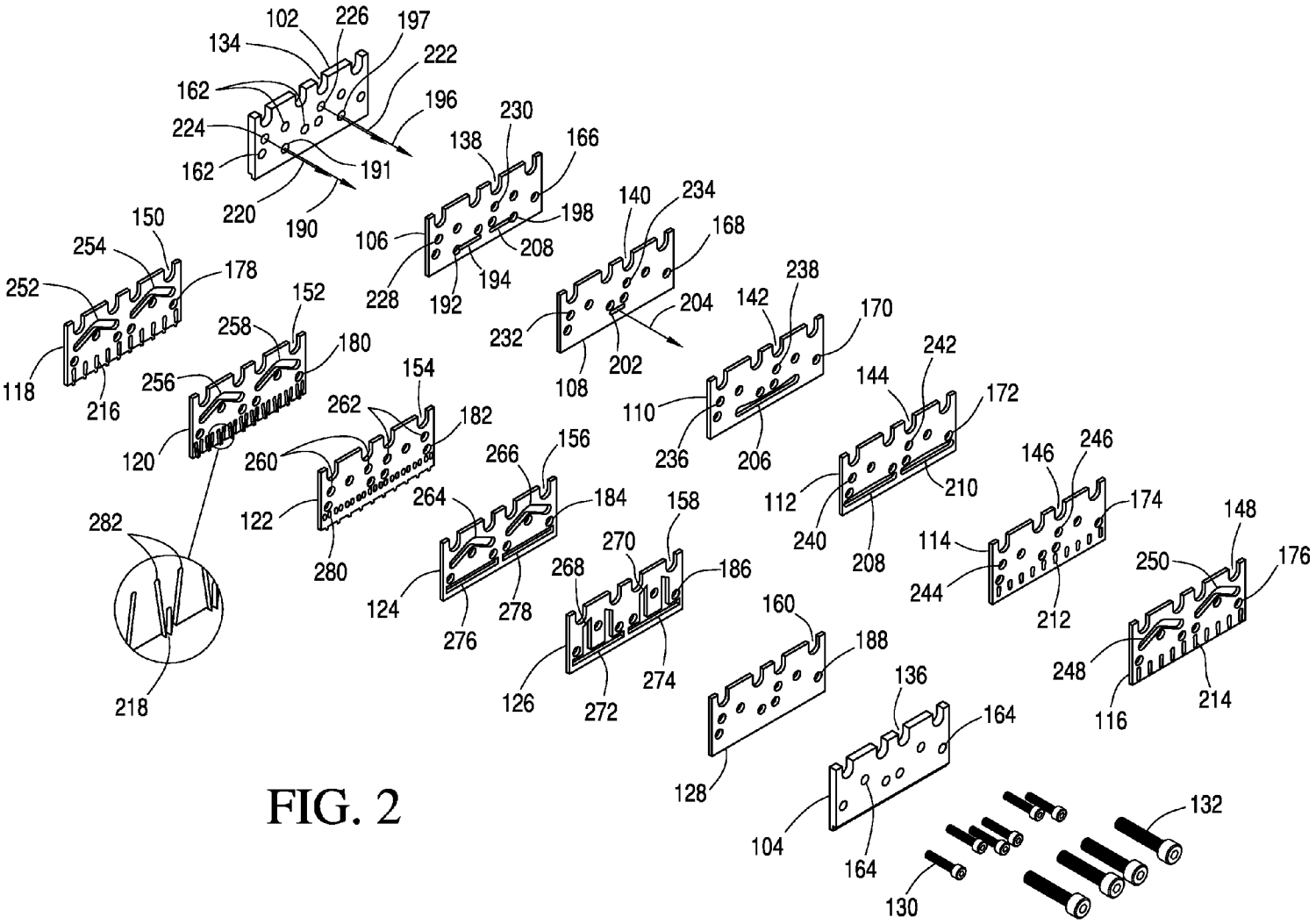
FIG. 2 is an exploded perspective view of the new and improved variable volume hot melt adhesive dispensing nozzle or die assembly, as shown in FIG. 1, wherein the various plates comprising the dispensing nozzle or die assembly are disclosed.
Figure 3K:
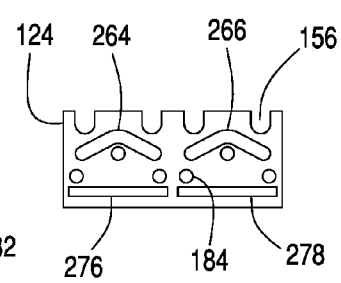
FIGS. 3*a*-3*n* are front elevational views of the individual plates comprising the new and improved variable volume hot melt adhesive dispensing nozzle or die assembly as shown in FIGS. 1 and 2.
Figure 3J:
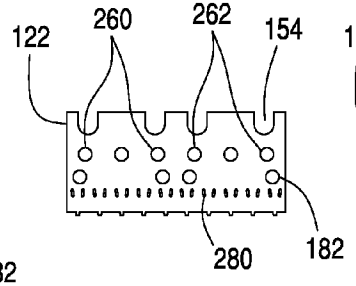
Figure 3H:
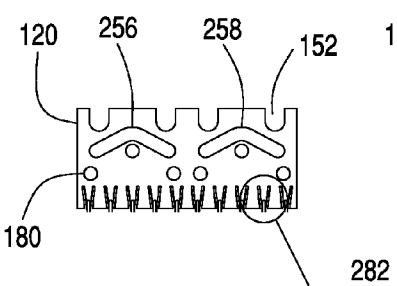
Figure 3I:
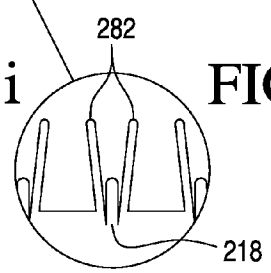
Figure 3H:
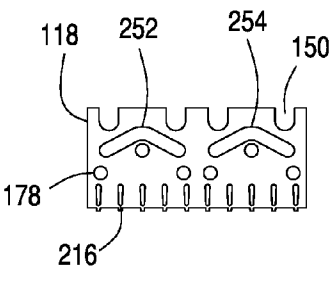
Figure 3N:
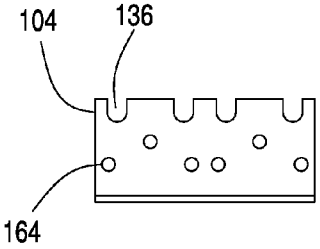
Figure 3M:
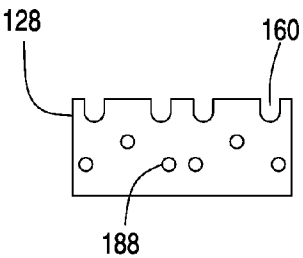
Figure 3L:
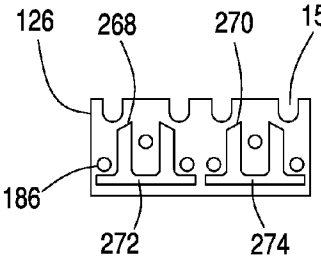

With reference continuing to be made to FIGS. 2-3*n*, it is to be appreciated that in accordance with the principles and teachings of the present invention, it is desired to develop a hot melt adhesive or other thermoplastic material dispensing nozzle or die assembly for dispensing or depositing hot melt adhesives or other thermoplastic materials onto a substrate in accordance with particularly desired or required deposition patterns comprising variable volumes of, for example, two hot melt adhesives or other thermoplastic materials to be dispensed or deposited onto the substrate at particular or specified locations. More particularly, it is seen that a first volumetric fluid flow of a first hot melt adhesive or other thermoplastic material, denoted by means of the flow arrow 190, passes through the first interior assembly cover plate 102 and exits from a first fluidsupply port 191, and that the first fluid flow 190 subsequently passes through a first fluid aperture 192 defined within a lower portion of the first fluid control plate 106. The first fluid aperture 192 is fluidically connected to a first horizontally oriented choke slot 194 also defined within the lower portion of the first interior assembly cover plate 102. In a similar manner, it is noted that a second volumetric fluid flow of a second hot melt adhesive or other thermoplastic material, denoted by means of the flow arrow 196, also passes through the first interior assembly cover plate 102 and exits from a second fluid supply port 197, and that the second fluid flow 196 subsequently passes through a second fluid aperture 198 also defined within the lower portion of the first fluid control plate 106. The second aperture 198 is similarly fluidically connected to a second horizontally oriented choke slot 200 also defined within the lower portion of the first interior assembly cover plate 102. It is noted that the first and second fluid apertures 192 and 198 are disposed transversely remote from each other, while the first and second choke slots 194 and 200 are disposed somewhat adjacent to each other. In this manner, the first and second fluid flows will flow from the transversely remote first and second fluid apertures 192,198 and through the first and second choke slots 194, 200 such that the resulting fluid flow outputs will effectively exit from the first fluid control plate 106 at a substantially central portion of the first fluid control plate 106. Accordingly, it is further seen that a third fluid flow aperture 202 is defined within a lower central portion of the second fluid control plate 108 such that a single fluid flow, effectively comprising the combined flow of the first and second fluid flows 190,196, exits the third fluid flow aperture 202 as the combined fluid flow which is denoted by means of the fluid flow arrow 204.

Continuing further, the combined fluid flow 204 will next flow toward the third fluid control plate 110 within which there is defined, at a relatively central region within the lower portion of the fluid control plate 110, a first transversely extending primary fluid distribution slot 206 which serves to effectively distribute the fluid flow 204 in a transversely balanced manner. The fluid flow 204 will then exit the third fluid control plate 110 and flow toward the fourth fluid control plate 112 within which there is defined, within the lower portion of the fluid control plate 112, a pair of laterally spaced, transversely extending secondary fluid distribution slots 208, 210 which serve to effectively pass the balanced fluid flow toward a plurality of laterally or horizontally spaced nozzle feed apertures 212 which are disposed within a transversely extending array across the lower edge portion of the fifth fluid control plate 114. It will be noted that the sixth fluid control plate 116 and the seventh fluid control plate 118 are likewise provided with similar nozzle feed apertures 214 and 216, respectively, however, it is to be appreciated that the nozzle feed apertures 214 and 216 are progressively changing in aperture size such that the fluid flow of hot melt adhesive or other thermoplastic material flows therethrough in a balanced manner under constant pressure conditions. The fluid flows will then flow toward a plurality of dispensing nozzles 218, which are disposed within a transversely extending array across the lower edge portion of the eighth fluid control plate 120, from which the hot melt adhesive or other thermoplastic material will be dispensed under constant volume conditions as determined by means of the volumetric flows originally developed by means of the original first and second fluid flows 190,196.

Having described substantially all of the major components of the variable volume hot melt adhesive or other thermoplastic material dispensing nozzle or die assembly 100 in order to dispense or deposit a dual-component hot melt adhesive or other thermoplastic material, as a combined flow of the dual-component hot melt adhesive or other thermoplastic material, onto an underlying substrate in accordance with the principles and teachings of the present invention, a brief description of the operation of the dispensing nozzle or die assembly 100 will now be provided. When the control valves controlling the first and second fluid flows 190,196 are both closed, there will obviously be no dispensing of any hot melt adhesive or other thermoplastic material. In a similar manner, a partial dispensing of hot melt adhesive or other thermoplastic material can be achieved by opening either one of the control valves controlling one of the first and second volumetric fluid flows 190, 196. In addition, assuming that the control valve controlling the first volumetric fluid flow 190 has been opened, the first volumetric fluid flow 190 is permitted to flow continuously. If the control valve controlling the second volumetric fluid flow 196 is then also opened, the second volumetric fluid flow 196 will in effect be superimposed upon the first volumetric fluid flow 190 and in effect cause an increase in the overall volumetric fluid flow as may be desired or required in accordance with predetermined or specified hot melt adhesive or other thermoplastic material dispensing patterns. Subsequently, if the second volumetric fluid flow 196 is terminated as a result of, for example, its fluid control valve being closed, so as to achieve a different particularly specified or predetermined hot melt adhesive or other thermoplastic material dispensing or deposition pattern, the second choke slot 200 will effectively cause a sufficient pressurized volume of the second fluid flow 196 to be retained or stored upstream of the second choke slot 200 whereby this retained or stored pressurized volume of the second fluid flow 196 can be subsequently released over a period of time. This fluidic occurrence or pressurized state has the effect of delaying the reaction of the negative pressure spike, attendant the closing of the second fluid control valve and the stoppage of the second fluid flow, upon the first fluid flow. Accordingly, the first fluid flow will smoothly transition from the combined or dual-fluid flow to the single fluid flow conditions without the dispensing or deposition of the hot melt adhesive or other thermoplastic material experiencing any adverse dispensing or deposition characteristics, such as, for example, a gap or space in the deposited hot melt adhesive or other thermoplastic material.

More particularly, for the choke slot 200 to work or operate properly, whereby the retained or stored pressurized volume of the second fluid flow 196 can in fact be released over a predetermined period of time with the desired results, the cross-sectional area of the choke slot 200 must be substantially equal to or slightly less than (≤) the cross-sectional areas of all ten of the dispensing nozzles 218. During this mode of operation, that is, when the second fluid flow 196 has been terminated, it will be appreciated that the volume of the dispensed hot melt adhesive or other thermoplastic material, in the form of dispensed filaments dispensed or deposited from the dispensing nozzles 218 onto the underlying substrate, will effectively smoothly transition from filaments having a relatively large diametrical cross-section, corresponding to that point in time when both fluid flows 190,196 were flowing, to filaments having a relatively small diametrical cross-section, corresponding to that point in time when the second fluid flow 196 was terminated and when the retained or stored pressurized volume of the second fluid flow 196 has been released or dissipated over a predetermined period of time.

Continuing still further, while the aforenoted choke structure can be utilized in conjunction with various different types of hot melt adhesive dispensing or deposition systems, the hot melt adhesive or other thermoplastic material dispensing nozzle or die assembly, as illustrated within FIGS. 1-3*n*, is particularly utilized or adapted for use as a hot melt adhesive or other thermoplastic material spray device, and accordingly, requires an attendant supply of heated air to be used in conjunction with the fluid flows of the hot melt adhesive or other thermoplastic material being dispensed from the dispensing nozzles and onto the underlying substrate in order to achieve the desired or required hot melt adhesive or other thermoplastic material deposition patterns. More particularly, with reference continuing to be made to FIGS. 2-3*n*, first and second hot air flows 220,222 are conducted through a first set of apertures 224,226 defined within the first interior assembly cover plate 102. Similar sets of fluid flow apertures 228-246 are respectively provided within the fluid control plates 106-114. Fluid control plates 116-120 are respectively provided with pairs of laterally spaced, substantially arcuately shaped air slots 248-258 for receiving the air flows 220,222 from the apertures 244,246 within fluid control plate 114, and for effectively transforming the substantially linearly oriented air flows into laterally or transversely extending air flow arrays. After traversing the arcuately-shaped air slots 256,258 defined within the fluid control plate 120, the air flows 220,222 will respectively pass through first and second sets of apertures 260, 262 which are defined within the ninth fluid control plate 122 so as to be fluidically aligned with the opposite ends of each one of the arcuately-shaped air slots 256, 258.

In turn, the tenth fluid control plate 124 is provided within a pair of laterally spaced substantially arcuately-shaped air slots 264,266 for receiving the air flows 220,222 from the apertures 260,262 and for respectively conducting the air flows 220,222 toward the upper end portions or upstanding legs of two substantially U-shaped air distribution passageways 268,270 which are defined within the eleventh fluid control plate 126. It is further seen that the lower portions of the U-shaped air distribution passageways 268,270 are integrally provided with and fluidically connected to a pair of laterally spaced, horizontally oriented or transversely extending slots 272,274, and that still yet further, the tenth fluid control plate 124 is likewise provided with a pair of laterally spaced, horizontally oriented or transversely extending slots 276,278 adjacent to the lower edge portion thereof. In this manner, it can be appreciated that after the air flows 220,222 have passed through the arcuately-shaped apertures 264,266 of the tenth fluid control plate 124, and have entered the upper end portions of the upstanding legs of the air distribution passageways 268, 270 within the eleventh fluid control plate 126, the air flows 220,222 will be conducted downwardly through the passageways 268,270, into the air flow slots 272, 274, and into the air flow slots 276,278 defined within the tenth fluid control plate 124. Continuing still further, it is seen that the ninth fluid control plate 122 is provided with a horizontally disposed, transversely extending array of apertures 280 which are disposed within the vicinity of the lower edge portion of the ninth fluid control plate 122 and which are adapted to be fluidically connected to the air flow slots 276, 278 of the tenth fluid control plate 124. In this manner, the air flows 220, 222 will be conducted from the air flow slots 276,278 of the tenth fluid control plate 124, through the apertures 280 of the ninth fluid control plate 122, and into pairs of hot air inlets 282 which are respectively defined within lower regions of the eighth fluid control plate 120 and which are disposed upon opposite sides of each one of the dispensing nozzles 218 defined or provided within the lower edge portions of the eighth fluid control plate 120. It is to be appreciated that the plurality of apertures 280 are defined at height elevations or locations within the ninth fluid control plate 122 such that the exiting air flows 220,222 will enter the upper end portions of the hot air inlets 282 of the eighth fluid control plate 120 whereby such air flows 220,222 can then flow downwardly toward the dispensing nozzles 218 so as to in fact assist in the hot melt adhesive or other thermoplastic material dispensing or deposition onto an underlying substrate.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A variable volume hot melt adhesive dispensing nozzle or die assembly, comprising:

a first fluid flow of a first hot melt adhesive;

a second fluid flow of a second hot melt adhesive;

a plurality of hot melt adhesive dispensing nozzles, each one of said hot melt adhesive dispensing nozzle having a predetermined cross-sectional area;

first and second choke slots, defined within a first fluid control plate, for causing said first and second fluid flows of hot melt adhesive to flow toward each other such that said first and second fluid flows can be combined into a single fluid flow at a fluid flow location located downstream from said first and second choke slots, and for effectively delaying the reaction of pressure spikes upon said combined fluid flow when one of said first or second fluid flows of said first and second hot melt adhesives is intermittently discontinued; and a second fluid control plate located downstream from said first fluid control plate and said first and second choke slots for combining said first and second fluid flows of said first and second hot melt adhesives into a combined flow of hot melt adhesive and for conducting said combined flow of hot melt adhesive toward said plurality of hot melt adhesive dispensing nozzles.

2. The variable volume hot melt adhesive dispensing nozzle or die assembly as set forth in claim 1, wherein:

said dispensing nozzle or die assembly comprises a pair of assembly cover plates;

said at least one fluid control plate comprises a plurality of fluid control plates interposed between said pair of assembly cover plates; and a plurality of bolt fasteners for securing said pair of assembly cover plates and said plurality of fluid control plates together so as to form said dispensing nozzle or die assembly.

3. The variable volume hot melt adhesive dispensing nozzle or die assembly as set forth in claim 2, wherein:

said plurality of hot melt adhesive dispensing nozzles are defined upon one of said plurality of fluid control plates and are disposed within a horizontally oriented transversely extending array adjacent to a lower edge portion of said one of said plurality of fluid control plates.

4. The variable volume hot melt adhesive dispensing nozzle or die assembly as set forth in claim 3, wherein:

said dispensing nozzle or die assembly is adapted for spraying said first and second hot melt adhesives onto a substrate from said plurality of hot melt adhesive dispensing nozzles.

5. The variable volume hot melt adhesive dispensing nozzle or die assembly as set forth in claim 4, further comprising:

first and second hot air flows for use in conjunction with said dispensing of said first and second hot melt adhesives from said plurality of hot melt adhesive dispensing nozzles onto the substrate.

6. The variable volume hot melt adhesive dispensing nozzle or die assembly as set forth in claim 5, further comprising:

fluid passageways defined within said plurality of fluid control plates for routing said first and second hot melt adhesives, said combined flow of said first and second hot melt adhesives, and said first and second hot air flows, through said dispensing nozzle or die assembly and toward said plurality of hot melt adhesive dispensing nozzles.

7. The variable volume hot melt adhesive dispensing nozzle or die assembly as set forth in claim 1, wherein:

each one of said first and second chokes has a cross-sectional area which is substantially the same as or less than (≤) the sum total of the cross-sectional areas of all of said plurality of hot melt adhesive dispensing nozzles.

8. A variable volume hot melt adhesive dispensing nozzle or die assembly, comprising:

a first fluid flow of a first hot melt adhesive;

a second fluid flow of a second hot melt adhesive;

a plurality of hot melt adhesive dispensing nozzles, each one of said hot melt adhesive dispensing nozzle having a predetermined cross-sectional are first and second choke slots, defined within a first fluid control plate, for causing said first and second fluid flows of hot melt adhesive to flow toward each other such that said first and second fluid flows can be combined into a single fluid flow at a fluid flow location located downstream from said first and second choke slots, and for effectively delaying the reaction of pressure spikes upon said combined fluid flow when one of said first or second fluid flows of said first and second hot melt adhesives is intermittently discontinued; and a second fluid control plate for combining said first and second fluid flows of said first and second hot melt adhesives into a combined flow of hot melt adhesive such that said second fluid flow of said second hot melt adhesive is superimposed upon said first fluid flow of said first hot melt adhesive and for conducting said combined flow of hot melt adhesive toward said plurality of hot melt adhesive dispensing nozzles.

9. The variable volume hot melt adhesive dispensing nozzle or die assembly as set forth in claim 8, wherein:

said dispensing nozzle or die assembly comprises a pair of assembly cover plates;

said at least one fluid control plate comprises a plurality of fluid control plates interposed between said pair of assembly cover plates; and a plurality of bolt fasteners for securing said pair of assembly cover plates and said plurality of fluid control plates together so as to form said dispensing nozzle or die assembly.

10. The variable volume hot melt adhesive dispensing nozzle or die assembly as set forth in claim 9, wherein:

said plurality of hot melt adhesive dispensing nozzles are defined upon one of said plurality of fluid control plates and are disposed within a horizontally oriented transversely extending array adjacent to a lower edge portion of said one of said plurality of fluid control plates.

11. The variable volume hot melt adhesive dispensing nozzle or die assembly as set forth in claim 10, wherein:

said dispensing nozzle or die assembly is adapted for spraying said first and second hot melt adhesives onto a substrate from said plurality of hot melt adhesive dispensing nozzles.

12. The variable volume hot melt adhesive dispensing nozzle or die assembly as set forth in claim 11, further comprising:

first and second hot air flows for use in conjunction with said dispensing of said first and second hot melt adhesives from said plurality of hot melt adhesive dispensing nozzles onto the substrate.

13. The variable volume hot melt adhesive dispensing nozzle or die assembly as set forth in claim 12, further comprising:

fluid passageways defined within said plurality of fluid control plates for routing said first and second hot melt adhesives, said combined flow of said first and second hot melt adhesives, and said first and second hot air flows, through said dispensing nozzle or die assembly and toward said plurality of hot melt adhesive dispensing nozzles.

14. The variable volume hot melt adhesive dispensing nozzle or die assembly as set forth in claim 8, wherein:

each one of said first and second chokes has a cross-sectional area which is substantially the same as or less than (≤) the sum total of the cross-sectional areas of all of said plurality of hot melt adhesive dispensing nozzles.

15. A variable volume hot melt adhesive dispensing nozzle or die assembly, comprising:

a first fluid flow of a first hot melt adhesive;

a second fluid flow of a second hot melt adhesive;

a plurality of hot melt adhesive dispensing nozzles, each one of said hot melt adhesive dispensing nozzle having a predetermined cross-sectional area;

first and second choke slots, defined within a first fluid control plate, for causing said first and second fluid flows of hot melt adhesive to flow toward each other such that said first and second fluid flows can be combined into a single fluid flow at a fluid flow location located downstream from said first and second choke slots, and for effectively delaying the reaction of pressure spikes upon said combined fluid flow when one of said first or second fluid flows of said first and second hot melt adhesives is intermittently discontinued and continued; and a second fluid control plate for combining said first and second fluid flows of said first and second hot melt adhesives into a combined flow of hot melt adhesive such that said second fluid flow of said second hot melt adhesive is superimposed upon said first fluid flow of said first hot melt adhesive and for conducting said combined flow of hot melt adhesive toward said plurality of hot melt adhesive dispensing nozzles.

16. The variable volume hot melt adhesive dispensing nozzle or die assembly as set forth in claim 15, wherein:

said dispensing nozzle or die assembly comprises a pair of assembly cover plates;

said at least one fluid control plate comprises a plurality of fluid control plates interposed between said pair of assembly cover plates; and a plurality of bolt fasteners for securing said pair of assembly cover plates and said plurality of fluid control plates together so as to form said dispensing nozzle or die assembly.

17. The variable volume hot melt adhesive dispensing nozzle or die assembly as set forth in claim 16, wherein:

said plurality of hot melt adhesive dispensing nozzles are defined upon one of said plurality of fluid control plates and are disposed within a horizontally oriented transversely extending array adjacent to a lower edge portion of said one of said plurality of fluid control plates.

18. The variable volume hot melt adhesive dispensing nozzle or die assembly as set forth in claim 17, wherein:

said dispensing nozzle or die assembly is adapted for spraying said first and second hot melt adhesives onto a substrate from said plurality of hot melt adhesive dispensing nozzles.

19. The variable volume hot melt adhesive dispensing nozzle or die assembly as set forth in claim 18, further comprising:

first and second hot air flows for use in conjunction with said dispensing of said first and second hot melt adhesives from said plurality of hot melt adhesive dispensing nozzles onto the substrate.

20. The variable volume hot melt adhesive dispensing nozzle or die assembly as set forth in claim 19, further comprising:

fluid passageways defined within said plurality of fluid control plates for routing said first and second hot melt adhesives, said combined flow of said first and second hot melt adhesives, and said first and second hot air flows, through said dispensing nozzle or die assembly and toward said plurality of hot melt adhesive dispensing nozzles.

21. The variable volume hot melt adhesive dispensing nozzle or die assembly as set forth in claim 15, wherein:

each one of said first and second chokes has a cross-sectional area which is substantially the same as or less than (≤) the sum total of the cross-sectional areas of all of said plurality of hot melt adhesive dispensing nozzles.

* * * * *